US005798774A

United States Patent [19]

Okada et al.

[11] Patent Number: 5,798,774

[45] Date of Patent: Aug. 25, 1998

[54] GAS ASSISTED INK JET APPARATUS AND METHOD

[75] Inventors: Akihiro Okada, Agoura; Joseph A. Lahut, Thousand Oaks; David O. Ward, Westlake Village, all of Calif.

[73] Assignee: Dataproducts Corporation, Simi Valley, Calif.

[21] Appl. No.: 608,551

[22] Filed: Feb. 28, 1996

[51] Int. Cl.[6] ..... B41J 2/015

[52] U.S. Cl. ..... 347/21; 347/70

[58] Field of Search ..... 347/20, 21, 68, 347/70, 71, 48

[56] References Cited

U.S. PATENT DOCUMENTS

| | | | |
|---|---|---|---|
| 4,417,259 | 11/1983 | Maeda | 346/140 |
| 4,418,355 | 11/1983 | DeYoung | 346/140 R |
| 4,598,303 | 7/1986 | Peekema et al. | 346/140 R |
| 4,728,969 | 3/1988 | Le et al. | 346/140 R |

*Primary Examiner*—Benjamin K. Poller
*Assistant Examiner*—Juanita Stephens
*Attorney, Agent, or Firm*—Pillsbury Madison & Sutro LLP

[57] ABSTRACT

A gas assisted liquid jet apparatus, suitable for use in ink jet printers, includes a transducer housing having a plurality of ink passages and is designed to be used with solid or hot melt ink. The apparatus operates with a compressed air source to provide a laminar air flow through an orifice from where ink is ejected. As a result, ink ligaments and droplets uniformly accelerate toward the printing medium, and the high speed laminar flow reduces friction at the orifice, thus reducing the formation of ink ligaments or satellite droplets. The apparatus may be made by attaching different layered members together. This improves the efficiency and ease of fabrication of multiple array liquid jet apparatus. Because of the layered structure, ink passages and air chambers each may be placed in a selected layered member or in more than one layered member. The location of the ink passages in the same layer or structure, such as the transducer housing, as a heater provides improved heating capabilities. The location of the ink passages in the transducer housing also minimizes the overall width of the apparatus.

29 Claims, 4 Drawing Sheets

GAS ASSISTED INK JET APPARATUS AND METHOD

BACKGROUND OF THE INVENTION

1. Field of the Invention

This invention relates to ink jet apparatuses and methods for ink jet printers, and in particular embodiments, to an air assisted drop on demand ink jet apparatus for jetting a phase change medium, such as solid ink.

2. Related Art

Preferred embodiments of the present invention relate to a gas assisted ink jet apparatus for ejecting droplets of a liquid phase medium, such as ink, with the assistance of pressurized, heated gas, such as air, onto paper or other substrate to generate images, text, or other patterns.

Typical drop-on-demand ink jet apparatuses operate to eject ink droplets from an ink jet head by selective actuations of one or more transducers within the ink jet head. For example, U.S. Pat. No. 4,418,355 to DeYoung et al. describes an ink jet head having several jets, each jet having a piezoelectric transducer in pressure communication with an ink chamber which is in liquid flow communication with a small jet opening. Ink droplets are formed from ink in the ink chambers and are ejected through the small jet openings in the ink jet head by selective actuations of the piezoelectric transducers. The ejected ink droplets travel at a relatively high velocity, across a gap from the ink jet head to a printing substrate.

Some ink jet printing apparatuses have been designed to operate with phase change or solid ink—inks that are heated to melt or transition from a solid phase to a liquid phase prior to ejection. Such printing apparatuses typically employ a heating mechanism, such as a resistive heater, in the ink jet head to melt or maintain the ink in a liquid state for ejection.

Ink jet printing, particularly phase change or solid ink jet printing, can place great demands on the ink jet printing apparatus. In typical printing environments, paper dust and debris tends to accumulate on the surface of the opening where ink droplets are ejected. This often causes jets to deprime (resulting in missing jets) during or following the operation of a printer. Introduction of debris into the ink chamber when the apparatus is in a stand-by mode is another, more permanent, cause of failure of ink jet printers. When the ink jet head cools down, through the phase transition of the hot melt ink, ink shrinkage tends to pull surface debris into the jet openings and can be difficult, if not impossible, to remove once it is internally incorporated. In particular industrial applications, such as printing on fabric or corrugated boxes, printing equipment is required to operate in relatively dusty and dirty factory environments. Lack of reliability in these environments has limited the acceptance of ink jet printing in these applications.

Another problem that tends to affect drop on demand ink jet printers, especially those designed to operate with relatively high viscosity mediums and/or hot melt or solid mediums, is the formation of ligaments on and around ejected droplets. Ligaments can result in poor dot formation and poor print quality. Because many suitable ink materials have surface tensions typically of 29+/−2 dyne/centimeters, the ligament length cannot be reduced beyond certain limits by modification of the surface tension of the ink composition.

The ligament phenomenon typically results in a ligament head velocity of about 13 meters/second and a tail velocity of about 7 meters/second. As a result, a ligamented droplet in flight elongates as it travels further from the jetting device. Practically, this sets a limit on the print gap (the distance between the ink jet head and the printing surface or substrate) and the relative translational speed between the print head and the printing surface. For example, with a print gap of 1 millimeter (0.04") and translational speed of 25 inches per second, the difference in arrival time of the head and tail is approximately 200 micro-seconds, which corresponds to 0.005". Since high resolution printing typically requires dot sizes of less than 0.005", any increase in print gap or traverse speed results in unacceptable dot size or shape. Although ink jet heads are capable of higher frequency operation, the ligament length control tends to limit the useable frequency to approximately 7.5 KHz at 300 dots per inch. However, industrial applications and high duty cycle environments, such as spot color on 310 ppm continuous forms printers, require larger printing gaps, higher frequency and high reliability.

Another concern often associated with solid ink jet printing is in the control of dot size on the print media. Typically, this is accomplished by control of the temperature of jetted ink and print media temperature. These conditions dictate the solidification time of the solid ink droplet on the print media and thereby control the drop spread, dot size and penetration into the print media.

One trend has been to employ compressed air to accelerate droplets of ejected ink, such as illustrated in U.S. Pat. No. 4,106,032 of Miura et al. The Miura patent describes a two compartment ink chamber ink jet head which comprises an inner and an outer ink compartments which communicate with one another through a connecting conduit, and an air source for facilitating the ejection of ink droplets emitted from the outer ink chamber. However, there are a number of drawbacks associated with this apparatus. For example, it can be difficult to align the connecting passageways, internal ink orifice outlet, and main external orifice outlet. Also, because of the internal passageways' location and size, they are difficult to clean when the passageways are clogged with contaminants. Another form of air assisted ink jet head is illustrated in U.S. Pat. No. 4,728,969 of Le et al. It describes an air-assisted drop-on-demand ink jet head with a single compartment ink chamber

SUMMARY OF THE DISCLOSURE

A gas assisted ink jet apparatus according to an embodiment of the invention includes, or is operable with, a compressed air source and is suitable for use in ink jet printers. The apparatus comprises a transducer housing, a diaphragm member, at least one liquid chamber and an air chamber housing. The transducer housing contains at least one transducer member and a plurality of passages for the containment of liquid, such as ink.

The liquid chamber has a base and an outlet. The base of the liquid chamber is coupled to the transducer housing through the diaphragm member, such that movement exerted by the transducer member is communicated to the chamber by the movement the diaphragm member causing ink droplets to be ejected through the outlet. The chamber is also in fluid flow communication with the ink passages in the transducer housing to receive ink from the same.

The air chamber housing has an orifice arranged in alignment with the outlet of the liquid chamber. The air chamber housing also has an air chamber in air flow communication with the compressed air source and the air chamber orifice. The air chamber is adapted to produce a laminar air flow through the orifice. As a result, the air chamber provides outwardly directed air stream through the orifice which assists in the ejection of ink droplets from the liquid chamber outlet and through the air chamber orifice. The air stream provides a laminar flow which assists the ejection of ink droplets and controls ligament lengths on the droplets. The air flow also provides a cleaning effect for removing accumulations of ink at or near the ink ejection orifice.

In preferred embodiments, the air is heated, either by a heater associated with the compressed air source, a heater disposed between the compressed air source and the ink jet head and/or a heater located within or mounted to the ink jet head. The heated air affects the drop and dot formation of hot melt mediums and preferably, the heat source is adjustable to adjust the drop and dot forming characteristics of the ink jet apparatus.

In accordance with further preferred embodiments of the present invention, the apparatus is formed of a plurality of layered components, designed for improved efficiency and ease of manufacture and assembly. In one preferred embodiment, the layered components comprise a transducer housing, a first layered member adjacent and secured to the transducer housing, a second layered member adjacent and secured to the first layered member, a third layered member adjacent and secured to the second layered member, a fourth layered member adjacent and secured to the third layered member, a fifth layered member adjacent and secured to the fourth layered member, and a sixth layered member adjacent and secured to the fifth layered member.

The transducer housing has at least one transducer passage containing at least one transducer member, and a plurality of liquid passages connected to an inlet. The location of the liquid passages in the transducer housing provides various advantages, including improved heat conduction of heat from a heater located in or adjacent the transducer housing to the liquid passages and the ability to minimize the overall width of the apparatus.

The first layered member has at least one first channel which is in fluid flow communication with the passages, and an aperture for each transducer member, through which the transducer members may travel. The second layered member has a diaphragm member, at least one second channel, wherein the second channel is in alignment and in fluid flow communication with the first channel. The third layered member has a conduit in alignment and in fluid flow communication with each second channel. The fourth layered member has a plurality of air passages which are in air flow communication with the air source, and a chamber in alignment with each conduit. The fifth layered member has an orifice passageway in alignment with each chamber, and air conduits in air flow communication with the air passages. The sixth layered member has an orifice in alignment with each orifice passageway, and at least one air chamber which is in air flow communication with the air conduits.

A pressure adjustment or regulation device is preferably provided to allow adjustment of the air pressure, to allow adjustable ligament length control and/or to accommodate various print gaps. In addition, as noted above, preferred embodiments employ a heat source for heating the pressurized air to provide a heated column of air with the ejected droplet. The air heat source is preferably adjustable to allow control of the temperature of the heated column of air and, thus, temperature control of the droplet and printing substrate.

DETAILED DESCRIPTION OF THE PREFERRED EMBODIMENTS

Figure 1:
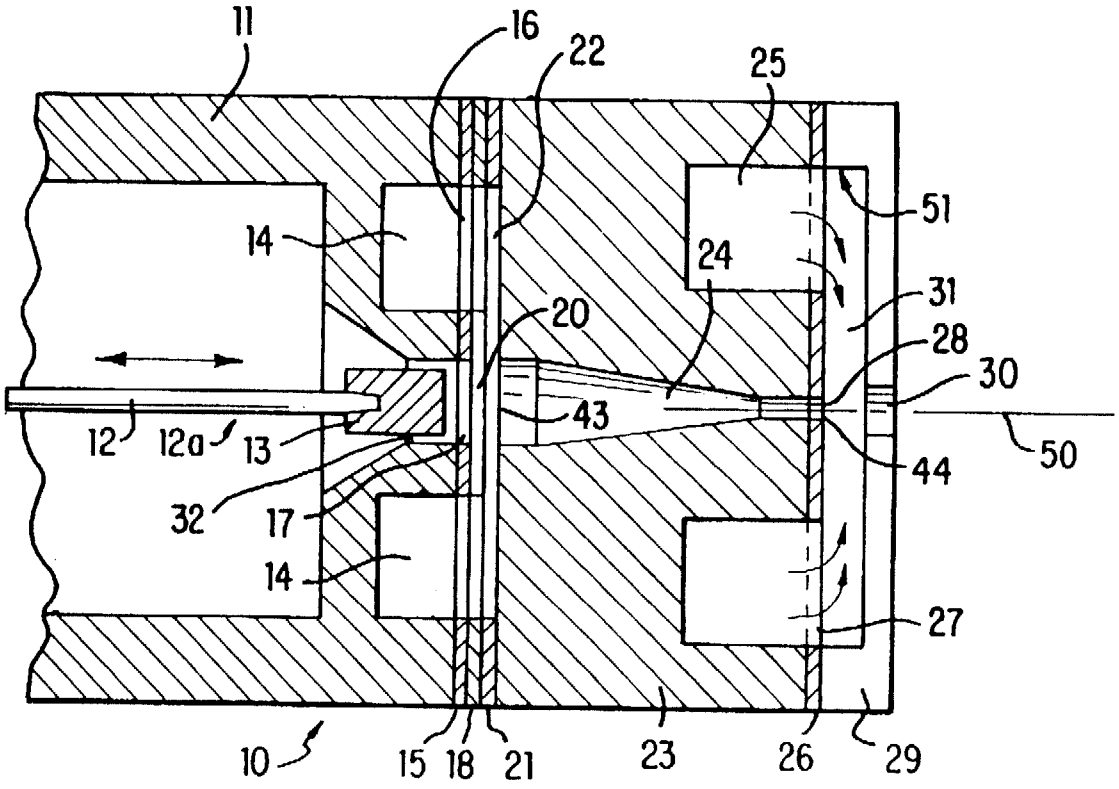
FIG. 1 is a cross sectional view of a gas assisted liquid jet apparatus according to an embodiment of the invention.
Figure 2:
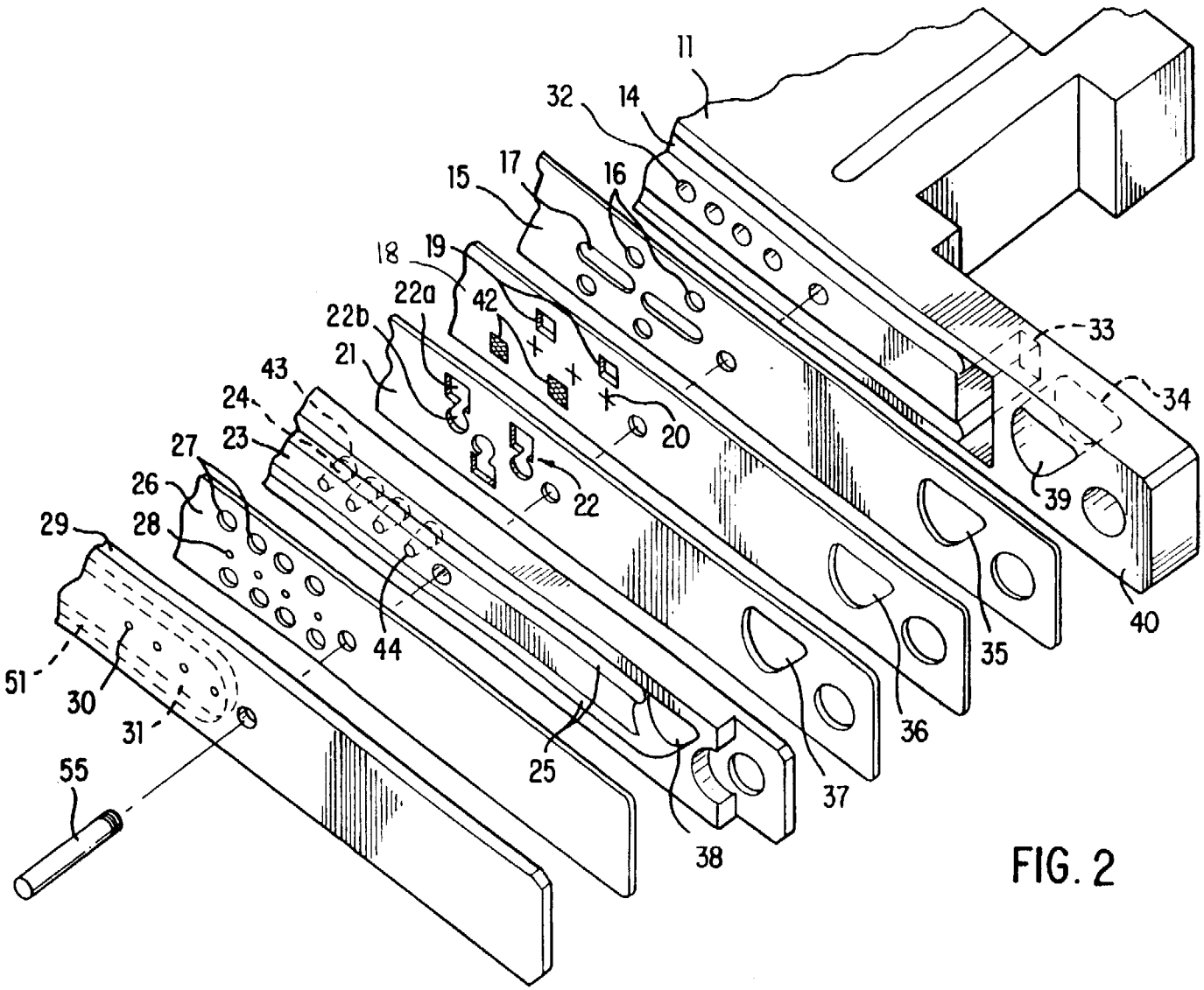
FIG. 2 is an exploded view of a gas assisted liquid jet apparatus according to an embodiment of the invention.

FIG. 1 illustrates a sectional view of a single ink jet device of a multiple-jet ink jet head. FIG. 2 illustrates a multiple-jet ink jet head (in an exploded view), employing multiple ink jet devices in an array. The number and arrangement of the ink jet devices may vary, according to various embodiments of the invention.

The device 10 shown in FIG. 1 is an air assisted solid ink jet device for ejecting ink droplets on-demand. As described in further detail below, preferred embodiments of the present invention employ gas, under pressure, to assist in the ejection of ink droplets. The pressurized gas provides a laminar air flow along the inner walls of the ink jet device for assisting the ejection of ink droplets through an ejection orifice. Preferably, the gas is heated to affect the droplet and dot formation of hot melt ink ejected from the orifice. Also, in preferred embodiments, the temperature of the gas is adjustable to adjust the droplet and dot characteristics. In further preferred embodiments, the gas pressure or velocity is adjustable to adjust the ligament length, print gap and dot characteristics.

For purposes of this application, ink jet devices are described with reference to ejecting droplets of ink for printing operations and, preferably, hot melt ink or solid ink (solid at room temperature). However, it will be understood that other suitable materials, such as thermoplastic compositions other than ink, adhesives, waxes, polymers or the like may be employed with ink jet apparatuses and methods according to further embodiments of the present invention.

The illustrated embodiment is particularly well suited for a layered ink jet head design, wherein the head is formed of layers or laminates. Such layered designs can significantly reduce the manufacturing costs and simplify the manufacturing process. For example, an air assisted solid ink jet apparatus 10 illustrated in FIGS. 1 and 2 comprises a transducer housing 11, a first layered member 15 adjacent and preferably secured to the transducer housing 11, a second layered member 18 adjacent and preferably secured to the first layered member 15, a third layered member 21 adjacent and preferably secured to the second layered member 18, a fourth layered member 23 adjacent and preferably secured to the third layered member 21, a fifth layered member 26 adjacent and preferably secured to the fourth layered member 23, and a sixth layered member 29 adjacent and preferably secured to the fifth layered member 26.

In the embodiment illustrated in FIGS. 1 and 2, the transducer housing 11 comprises a transducer member **12*a*, ink passages 14, an ink inlet 33, an air inlet 34, and a first air passage 39, wherein the transducer member 12*a* includes a foot 13 coupled to a transducer 12. The transducer 12 expands and contracts in directions indicated by the arrow shown in FIG. 1, along the axis of elongation of the transducer 12. The transducer 12 is coupled to an ink chamber 24 through a foot 13 and the second layered member 18 which is made of a flexible diaphragm or membrane. Hot melt ink under pressure is delivered to the ink inlet 33, flows through various ink passageways and fills the ink chamber 24 within the ink jet apparatus 10. The elongation of the transducer 12 exerts pressure to the ink chamber 24, and the increased pressure in the ink chamber 24 causes ejection of droplets of ink through an ink orifice passageway 28. The action of a transducer on a flexible diaphragm to cause ink droplet ejection in itself is described in U.S. Pat. No. 4,418,355 to DeYoung et al., incorporated herein by reference. However, according to embodiments of the present invention, ink droplets are assisted through an ink jet orifice 30 by pressurized air from the air chamber 31**.

The transducer housing 11 has a pair of ink passages 14 which are either machined or molded into a receiving surface 40, and through which hot melt ink from the ink inlet 33 is received. The ink passages are exposed but are abutted against the first layered member 15 during assembly. A transducer passage 32 is located between the pair of ink passages 14, wherein the ink passages 14 are symmetrically spaced from the transducer passage 32. The foot 13 coupled to the transducer 12, such as a piezoelectric or other suitable transducer, propagates through the transducer passage 32 as the length of the transducer 12 changes. The transducer passage 32 may have any suitable shape, preferably cylindrical, for easy sliding of the foot 13.

The first air passage 39 of the transducer housing 11, which provides a direct path from the air inlet 34 to a second air inlet 35 of the second layered member 15, is in air flow communication with the air inlet 34. A compressed air source (not shown) is connected to the air inlet 34 via a conduit (not shown) through which pressurized air is provided. The compressed air may be heated by either interposing an adjustable or regulatable heating source between the compressed air source and the ink jet apparatus, or by integrating the heating source into the transducer housing 11. Alternatively, the heating source may be installed within the compressed air source. For ink jet head designs for hot melt inks, a heater is typically located within or adjacent the head to maintain the ink in a liquid state for ejection. Further preferred embodiments of the invention employ such head heaters to heat the compressed air as the air passes through the head. Pressure of the air may be adjustable or regulatable by interposing a pressure adjustment valve between the compressed air source and the air inlet 34. Also, the temperature of the air may be adjusted by providing suitable heat adjustment mechanisms on or with the heater.

The first layered member 15, which is placed and secured between the transducer housing 11 and the second layered member 18, comprises first channels 16, a second air passage 35, and apertures 17. The first layered member 15 is positioned against the receiving surface 40 of the transducer housing 11 thus forming tight seals around the ink passages 14 and the first air passage 39. However, the ink passages 14 are in fluid flow communication with the first channels 16 for free flow of hot melt ink. Similarly, the second air passage 35 is substantially aligned with the first air passage 39 such that air flow can be freely communicated.

The aperture 17 of the first layered member 15 serves as a passageway of the foot 13 that is coupled to the transducer 12. It is axially aligned with the transducer passage 32 along axis 50 for smooth movement of the foot 13 through the transducer passage 32. The aperture 17 shown in FIG. 2 is elliptically shaped and sufficiently large to negotiate at least two separate openings of the transducer passages 32. In general, the elliptically shaped aperture 17 can be formed of any longitudinally suitable length to accommodate, for example, multiple transducer passages 32. To the same extent, the aperture 17 may be made smaller to accommodate only one transducer passage 32.

The second layered member 18, which is placed and secured between the first layered member 15 and the third layered member 21, comprises second channels 19, flexible diaphragms 20, and the third air passage 36. The second layered member 18 creates tight seals around the first channels 16 and the second air passage 35. The apertures 17 are closed by the second layered member 18 made with any suitable flexible materials, such as stainless steel or plastic, thereby forming a flexible diaphragm or membrane. The transducer 12, together with the second layered member 18 comprises one form of a pressure pulse generating actuator. The pressure created by the transducer 12 and the second layered member 18 arrangement is transmitted through the ink chamber 24. This causes the ejection of ink droplets from an ink orifice passageway 28.

As shown in FIG. 2, the second channels 19 are in fluid flow communication with the corresponding first channels 16 in the first layered member 15. Similarly, the third air passage 36 is in airflow communication with the second air passage 35.

The second layered member 18 has second channels 19 which, in preferred embodiments, includes screens 42 to filter out any unwanted debris or particles contained in hot melt ink.

The third layered member 21, which is placed and secured between the second layered member 18 and the fourth layered member 23, comprises ink conduits 22 and a fourth air passage 37, wherein the ink conduits 22 are in fluid flow communication with the second channels 19 and the fourth air passage 37 is in air flow communication with the third air passage 36. When secured to the second layered member 18, the third layered member 21 forms tight seals around the second channels 19 and the third air passage 36 to prevent any loss of ink and air pressure respectively. The ink conduit 22, which may be shaped in any manner sufficient to receive hot melt ink from the second channel 19 and to convey it to the ink chamber 24, comprises a receiving end **22*a* and a supplying end 22*b*. In the preferred embodiment of FIG. 1, in order to create tight seals, the receiving end 22*a* of the ink conduit 22 has the same shape as that of the second channel 19, and the supplying end 22*b* has the same shape as that of the base 43 of the ink chamber 24**.

The fourth layered member 23, which is placed and secured between the third layered member 21 and the fifth layered member 26, comprises a pair of air passages 25 and ink chambers 24, wherein each ink chamber has a base 43 and an ink outlet 44. The base 43 is in fluid flow communication with the supplying end **22*b* of the third layered member 21. In general, the ink chamber 24 depicted in FIGS. 1 and 2 is frustoconically shaped. However, the ink chamber 24 may be cylindrical or of other suitable shapes. The thickness of the fourth layered member 23 may be varied during fabrication of that member to control the volume of the ink chamber 24**.

Each ink chamber 24 is located between the pair of air passages 25, wherein the air passages 25 are symmetrically spaced from the ink chamber 24. The air passages 25 are in air flow communication with the air receiving passage 38 which in turn is in air flow communication with the fourth air passage 37. The fourth layered member 23 forms a tight seal around the fourth air passage 37 to prevent any loss of air pressure.

Preferably, both air passages 25 depicted in FIG. 1 have the same shape and volume. The symmetry allows even air pressure in the air chamber 31 and in outwardly ejected air through an ink jet orifice 30.

The fifth layered member 26, which is placed and secured between the fourth layered member 23 and the sixth layered member 29, comprises ink orifice passageways 28 and air conduits 27. The air conduits 27 are symmetrically situated from the ink orifice passageway 28. For each ink orifice passageway 28, a pair of air conduits 27 that are in air flow communication with the air passages 25 are provided. Other than the openings provided by the air conduits 27, the fifth layered member 26 provides tight seals around the air passages 25 to maintain a pneumatic condition.

The ink orifice passageway 28 is axially aligned with the ink outlet 44 of the ink chamber 24, as indicated by axis 50 in FIG. 1. For each ink chamber 24, there is a corresponding ink orifice passageway 28 in the fifth layered member 26. The ink orifice passageway 28 is of smaller diameter than the ink outlet 44 of the ink chamber 24 to prevent undemanded flow of hot melt ink through the opening. Other than the openings of ink orifice passageways 28, the fifth layer member 26 forms tight seals around the ink chambers 24 to prevent ink leakage.

The sixth layered member 29 comprises ink jet orifices 30, air chamber wail 51, and an air chamber 31. The fifth layered member 26 is secured to the air chamber wall 51 of the air chamber 31 to form an air tight seal. The air chamber 31 is symmetrically aligned along the axis 50 so that it is in air flow communication with the air passages 25 through the air conduits 27. The ink jet orifices 30 may be of any suitable shape, such as cylindrical or frustoconical shape. The thickness of the air chamber wall 51 dictates the volume of the air chamber.

The ink jet orifices 30 are also axially aligned with the corresponding ink orifice passageways 28, as indicated by the axis 50. Preferably, the opening size of the ink jet orifices 30 is greater than the ink orifice passageway 28. However, the opening should be small enough to maintain sufficient air pressure to accelerate ink droplets through the ink jet orifice 30.

Pressurized air is delivered to the air inlet 34 of the air assisted solid ink jet apparatus 10. Air passes through the various layered members and flows into the air chamber 31. As air approaches the center of the head, it changes direction and flows outwardly through the ink jet orifices 30. This air flow accelerates at least the ligament portions of ink droplets generated at the ink orifice passageways 28 in response to pressure pulses generated by the foot 13 coupled to the transducer 12. As described in more detail below, the resulting air flow assists in controlling the ink droplets as they are ejected outwardly from the ink orifice passageways 28. As a result, more uniform and symmetric ink drops with controlled ligament lengths may be generated by the ink jet apparatus 10. These drops travel through the ink jet orifice 30 and toward the printing media.

The bonding or securing of the above mentioned layered members may be achieved by attaching each layered member against an adjacent layered member using an adhesive or other suitable bonding materials or securing means. Alignment dowels 55 may be used to align the respective layers during bonding or securing steps.

In the illustrated embodiment, the above-noted layered members are formed as a unitary structure, e.g., from a single sheet of material, such as metal, which is cut and drilled to the configuration shown in FIG. 2. However, it will be readily recognized that each layered member and transducer housing may be formed by suitable processes, such as molding or extruding from a metal, plastic or other resin-type material.

Figure 3:
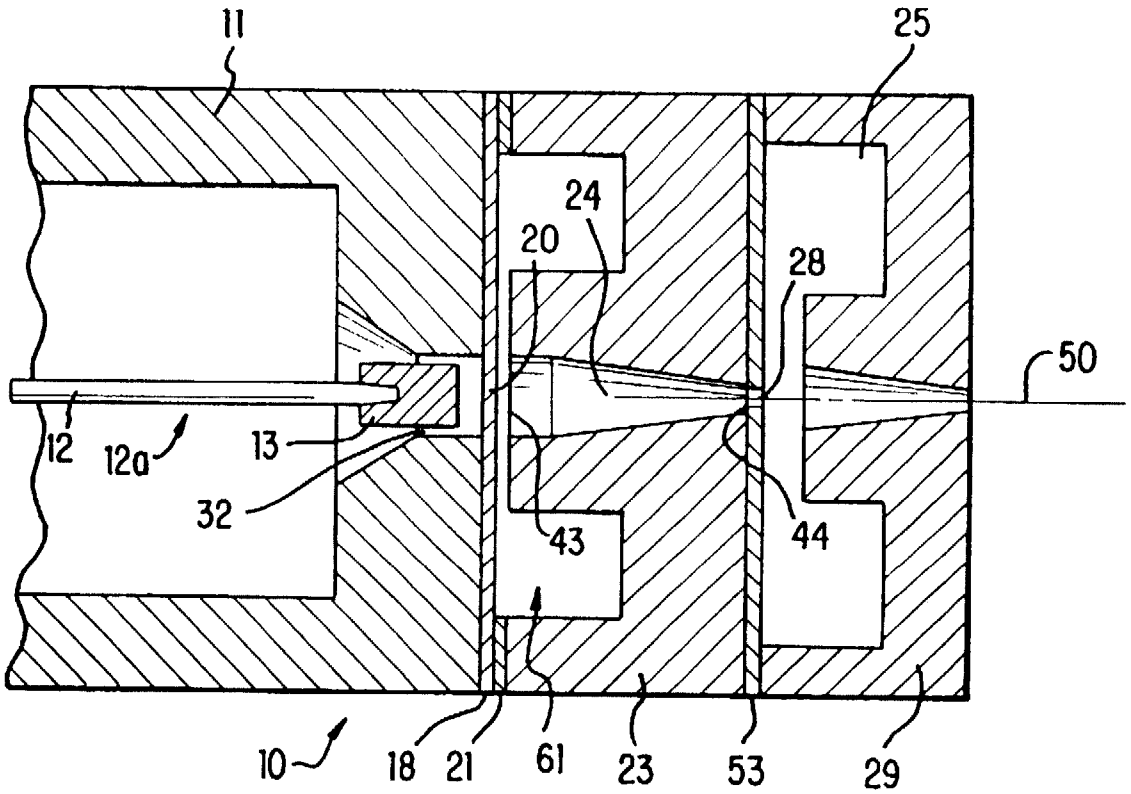
FIG. 3 is a cross sectional view of another embodiment of a gas assisted liquid jet apparatus.

Another possible embodiment, shown in FIG. 3, has a plurality of ink passages 61 fabricated into the fourth layered member 23, rather than having them in the transducer housing 11. In this embodiment, the first layered member 15 may be eliminated, and first channels 16 are no longer needed. Consequently, the ink passages 61 of the third layered member 21 are in fluid flow communication with the ink inlet 33 to receive hot melt ink. The ink passages 61 are also in fluid flow communication with the ink chamber 24.

Figure 4:
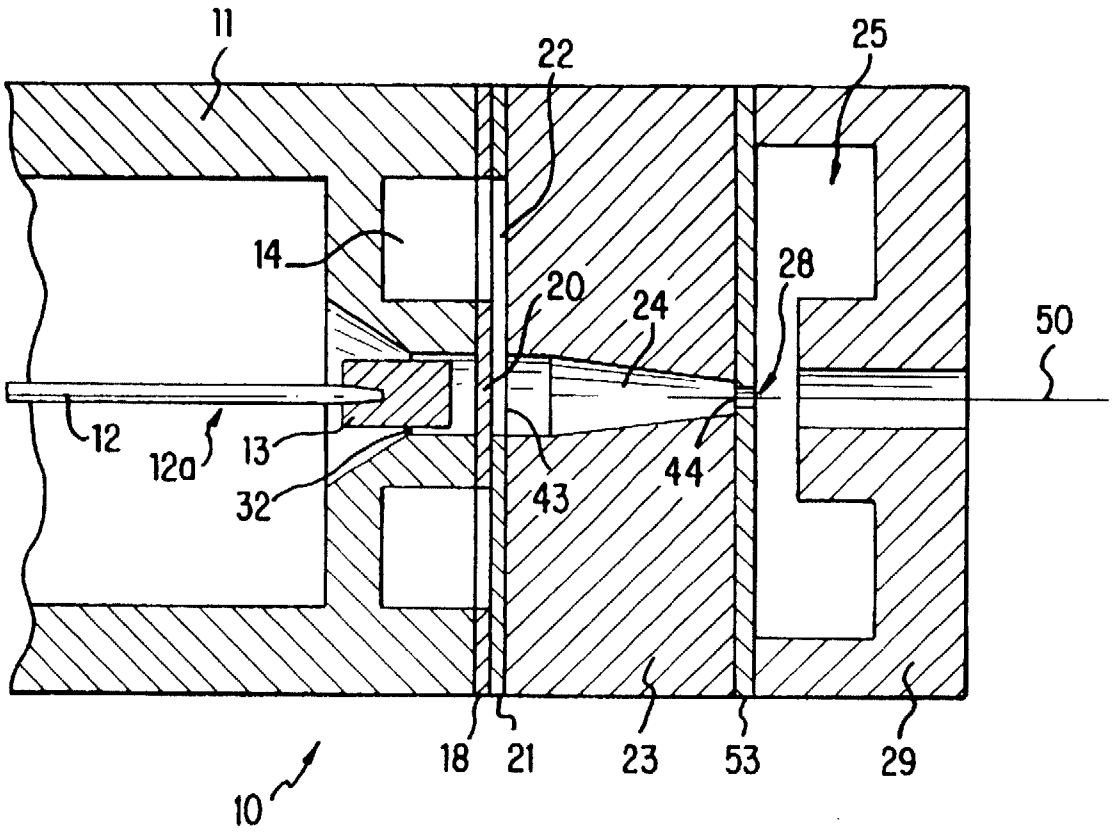
FIG. 4 is a cross sectional view of a further embodiment of a gas assisted liquid jet apparatus.

Another embodiment shown in FIG. 4 illustrates the ink jet apparatus without the first layered member 15, thus rendering the manufacturing process simpler. As a result, the second layered member 18, which is made of a flexible diaphragm or membrane is placed directly against the transducer housing 11. In addition, the air passages 25, which are shown in the fourth layered member 23 of FIG. 1, are omitted from that member, and instead, provided in the sixth layered member 29, eliminating the air conduits 27 from the fifth layered member 53. As a result, in lieu of the fifth layered member 26 with air conduits 27 as shown in FIG. 1, a different embodiment of the fifth layered member 53 with no air conduits is needed. In addition, the ink jet orifice 30 may be cylindrically tapered and aligned along the axis 50 to increase the air velocity at the output.

The above described embodiments of the present invention have many advantages, including the ease of manufacture and repair. As illustrated and described above, the preferred embodiments have a layered configuration, wherein the ink jet apparatus may be made by attaching different layered members. This minimizes manufacturing difficulties and expenses by eliminating the need for expensive cast parts. Also, because of this feature, any array of ink jet head may be manufactured. The rectangular column aligned along the jetting array is particularly applicable to multi-hole orifice configurations used in industrial applications where large dot size is required.

In preferred embodiments discussed above, the ink passages 14 are arranged in the transducer housing 11. This arrangement provides various benefits, including the availability of a larger volume of ink. Also, when using hot melt ink, it is preferred that a heating source be provided to prevent ink in the ink passages and chambers from hardening during operation. The heating source, such as a resistive heater, may be part of the ink jet apparatus, and are typically mounted to or in the transducer housing structure. Thus, the location of the ink passages 14 directly within the transducer housing allows the heat source to efficiently communicate heat through a single body (the transducer housing structure) to the ink in the ink passages 14. In contrast, if the ink passages where located in other layers, the heat from a heater mounted to the transducer housing would have to communicate through one or more layers and layer transitions, which can act as heat insulators and dissipaters.

The location of the ink passages 14 in the transducer housing also provides improvements with respect to the gas assist feature. With the ink passages 14 located in the transducer housing, rather than the fourth layered member 23 or other layer, the fourth layered member 23 may be made relatively thin, thus minimizing the overall width of the ink jet head. The ability to minimize the overall width of the ink jet head is particularly beneficial with the gas assist feature, as a means to offset at least some of the additional width provided by the additional layer or layers and a gas chamber employed with the gas assist feature.

The pressurized gas (or air) prevents debris particles from falling and/or accumulating on the ink jet orifices 30 and tends to "blow" out excess ink or debris accumulations from the ink jet orifices, thereby making jetting more reliable.

Still another advantage of the above embodiments is that by forming a high speed laminar flow at the exit of the ink jet orifice 30, ink ligaments or droplets can be uniformly accelerated toward the printing media. Additionally, the droplets of smaller size or satellite drops are accelerated at a higher speed due to their size and land on the printing media substantially at the same time and region, thus improving the resolution. Moreover, the high speed laminar flow reduces friction at the ink jet orifice 30, thus reducing the deformation of ink droplets as they are ejected from the orifice.

Another advantage is that the air velocity may be adjusted to increase the droplet velocity. In preferred embodiments, an air valve mechanism is interposed between a compressed air source and an ink jet head for adjusting air pressure provided to the air inlet 34. This allows the ink jet apparatus to be adjustable to accommodate various printing gaps and jetting frequencies and allows larger printing gaps and/or higher jetting frequencies with improved drop formation and shape. As noted above, ligaments formed on a viscous and/or hot melt ink droplet typically travel at a slower velocity than the head of the droplets. For example, the droplet head may travel at about 13 meters/second, while the ligament tail may travel at about 7 meters/second. In preferred embodiments, the gas (or air) velocity is adjusted or selected to be greater than the ligament tail velocity, but less than the ligament head velocity, such that velocity of the column of air acts on the ligament tail (to accelerate the tail) but has little or no effect on the droplet head. As a result, the air velocity is adjusted to minimize and/or otherwise control the ligament length.

In further preferred embodiments, the pressurized air is heated by an adjustable or regulatable heating source and/or by a heating source incorporated in the ink jet head, to produce a column of heated air through each ink jet orifice. The column of heated air provides low heat loss of the droplet in flight, when hot melt ink is used, and local heating of the printing substrate, thereby giving an additional level of control to the print quality and resolution. Substrate heating for the control of dot formation has previously been provided by, for example, heated platens arranged behind the printing substrate. However, according to preferred embodiments of the present invention, the precise location on the printing substrate at which an ejected ink droplet lands can be temperature controlled by the control of the column of heated air which accompanies the ejected droplet. The column of air is preferably adjusted to impinge on the same surface at about the same location and nearly the same time as the ejected droplet of ink. This can provide a distinct improvement over processes of pre-heating a substrate prior to printing or heating of the substrate from the surface opposite to the printing surface, wherein imprecise dissipation and conduction of heat through the substrate provide imprecise temperature control.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A gas assisted liquid jet apparatus operable with a compressed air source, the liquid jet apparatus comprising:

a transducer housing enclosing a plurality of transducer members and at least one passage for containment of liquid;

a plurality of diaphragm members associated with the transducer members;

wherein each transducer member dispose within the transducer housing is in pressure communication with a transducer member respective diaphragm member for selectively exerting a pressure on the diaphragm member;

a chamber housing enclosing a plurality of chambers associated with the plurality of diaphragm members, wherein the plurality of chambers are in fluid communication with the passage; each chamber has a base and an outlet, wherein said base is coupled to the transducer housing through the diaphragm member so when the pressure is selectively exerted by the transducer member, the pressure is transferred to the chamber by the diaphragm member causing selective ejection of liquid droplets through the outlet;

an air chamber located adjacent to the outlet of each of the chambers which is in air flow communication with the compressed air source; and a plurality of orifices associated with the chambers in alignment with the outlets and coupled to the air chamber to allow an air flow through the orifices with the ejection of liquid droplets.

2. An apparatus as recited in claim 1 in which the transducer member comprises a piezoelectric transducer coupled to a foot for producing pressure pulses against the diaphragm member.

3. An apparatus as recited in claim 1, wherein each orifice has a diameter in which the diameter of the orifice is greater than that of the outlet, however, small enough to maintain sufficient air pressure to accelerate liquid droplets through the orifice.

4. A gas assisted liquid jet apparatus operable with a compressed air source and suitable for use in ink jet printers, the apparatus comprising:

a transducer housing having a transducer passage, a plurality of passages for storing a liquid, and an inlet and a transducer member, wherein the plurality of passages are in fluid flow communication with the inlet, and the transducer member is mounted in the transducer passage;

a first layered member abutting against the transducer housing, the first layered member having at least one first channel and an aperture, wherein the first channel is in fluid flow communication with the plurality of passages, and the aperture is in alignment with the transducer passage through which the transducer member may travel;

a second layered member abutting against the first layered member, the second layered member having a diaphragm member, at least one second channel, wherein the second channel is in alignment with the first channel of the first layered member;

a third layered member abutting against the second layered member, the third layered member having a conduit which is in alignment and in fluid flow communication with the second channel;

a fourth layered member abutting against the third layered member, the fourth layered member having a plurality of air passages and a chamber, wherein the air passages are in air flow communication with the compressed air source, and the chamber is in alignment with the conduit;

a fifth layered member abutting against the fourth layered member, the fifth layered member having an orifice passageway and air conduits, wherein the orifice passageway is in alignment with the chamber, and the air conduits are in air flow communication with the air passages; and a sixth layered member abutting against the fifth layered member, the sixth layered member having an orifice and an air chamber, wherein the orifice is in alignment with the orifice passageway, and the air chamber is in air flow communication with the air conduits.

5. An apparatus as recited in claim 4 in which the transducer member further comprises a piezoelectric transducer and a foot coupled to the piezoelectric transducer, wherein the diaphragm member is coupled to the foot for movement.

6. An apparatus as recited in claim 4 in which the transducer housing further comprises two passages which may be filled with hot melt ink.

7. An apparatus as recited in claim 4 in which the aperture is elliptically shaped and sufficiently large to negotiate two separate openings of the transducer passages.

8. An apparatus as recited in claim 4 in which the second channel is equipped with a screen suitable for removing contaminants.

9. An apparatus as recited in claim 4 in which the chamber further comprises a base and an outlet, wherein the base of the chamber is in fluid flow communication with the conduit of the third layered member.

10. An apparatus as recited in claim 9, wherein the orifice has a diameter in which the diameter of the outlet is smaller than that of the base so that the chamber is of a frustoconical shape.

11. An apparatus as recited in claim 4, in which the chamber further comprises a base and an outlet, and wherein the orifice passageway is in alignment with the outlet and has a smaller diameter than the outlet to prevent undemanded flow of liquid through the opening of the orifice passageway.

12. An apparatus as recited in claim 4, wherein the orifice has a diameter in which the diameter of the orifice is greater than that of the orifice passageway, however, small enough to maintain sufficient air pressure to accelerate liquid droplets through the orifice.

13. An apparatus as recited in claim 4 in which the fourth layered member further comprises at least one supplemental passage which is in fluid flow communication with the conduit of the third layered member.

14. A gas assisted liquid jet apparatus operable with a compressed air source and suitable for use in ink jet printers, the apparatus comprising:

a transducer housing having a transducer passage, a plurality of passages for storing a liquid, an inlet and a transducer member, wherein the plurality of passages are in fluid flow communication with the inlet, and the transducer member is mounted in the transducer passage;

a first layered member abutting against the transducer housing, the first layered member having at least one first channel in fluid flow communication with the plurality of passages, and an aperture through which the transducer member may travel;

a second layered member abutting against the first layered member, the second layered member having a diaphragm member, at least one second channel, wherein the second channel is in alignment with the first channel of the first layered member;

a third layered member abutting against the second layered member, the third layered member having a conduit which is in alignment and in fluid flow communication with the second channel;

a fourth layered member abutting against the third layered member, fourth layered member having a chamber in alignment with the conduit;

a fifth layered member abutting against the fourth layered member, the fifth layered member having an orifice passageway in alignment with the chamber; and a sixth layered member abutting against the fifth layered member, the sixth layered member having an orifice in alignment with the orifice passageway, and an air chamber which is in air flow communication with the compressed air source.

15. A gas assisted liquid jet apparatus operable with a compressed air source and suitable for use in ink jet printers, the apparatus comprising:

a transducer housing having a transducer passage, a plurality of passages for storing a liquid, an inlet and a transducer member, wherein the plurality of passages are in fluid flow communication with the inlet, and the transducer member is mounted in the transducer passage;

a second layered member abutting against the transducer housing, the second layered member having a diaphragm member, at least one second channel, wherein the second channel is in alignment with the plurality of passages of the transducer housing;

a third layered member abutting against the second layered member, the third layered member having a conduit which is in alignment and in fluid flow communication with the second channel;

a fourth layered member abutting against the third layered member, fourth layered member having a chamber in alignment with the conduit; and a subsequent layered member abutting against the fourth layered member, the subsequent layered member having an orifice in alignment with the chamber, and an air chamber which is in air flow communication with the compressed air source.

16. An apparatus as recited in claim 15 in which the transducer member further comprises a piezoelectric transducer and a foot coupled to the piezoelectric transducer, wherein the diaphragm member is coupled to the foot for movement.

17. An apparatus as recited in claim 15 in which the second channel is equipped with a screen suitable for removing contaminants from the liquid.

18. An apparatus as recited in claim 15, in which the chamber further comprises a base, an outlet and an orifice passageway, wherein the base of the chamber is in fluid flow communication with the conduit of the third layered member, and the orifice passageway is in alignment with the outlet.

19. An apparatus as recited in claim 18 in which the outlet has a smaller diameter than the base, and the orifice passageway has a smaller diameter than the outlet to prevent undemanded flow of liquid through the opening of the orifice passageway.

20. An apparatus as recited in claim 15 in which the diameter of the orifice is greater than that of the orifice passageway, however, small enough to maintain sufficient air pressure to accelerate liquid droplets through the orifice.

21. A gas assisted liquid jet apparatus operable with a compressed air source and suitable for use in ink jet printers, the apparatus comprising:

a transducer housing having a plurality of transducer passages, two passages for storing ink, an inlet, a plurality of transducer members and a first air passage, wherein the passages are in fluid flow communication with the inlet, the first air passage is in air flow communication with the compressed air source, and each transducer member is mounted in a corresponding transducer passage;

the transducer member further comprising a piezoelectric transducer and a foot coupled to the piezoelectric transducer;

a first layered member abutting against the transducer housing, the first layered member comprising at least one first channel, a second air passage and a plurality of apertures through which the foot of the transducer members is moveable, wherein the first channel is in fluid flow communication with the passages, and the second air passage is in air flow communication with the first air passage;

a second layered member abutting against the first layered member, the second layered member having a plurality of diaphragm members, at least one second channel and a third air passage, wherein the second channel is aligned with the first channel of the first layered member, and the third air passage is in air flow communication with the second air passage;

a third layered member abutting against the second layered member, the third layered member having a plurality of conduits and a fourth air passage, wherein the ink conduit is in fluid flow communication with the second channel, and the fourth air passage is in air flow communication with the third air passage;

a fourth layered member abutting against the third layered member, fourth layered member comprising two air passages and a plurality of chambers each having a base and an outlet, wherein the base of the chamber is in fluid flow communication with the associated conduit of the third layered member, and the chamber is in alignment with the second channel, and the air passages are in air flow communication with the fourth air passage;

a fifth layered member abutting against the fourth layered member, the fifth layered member having a plurality of orifice passageways in alignment with the outlet of the chambers, and air conduits in air flow communication with the air passages; and a sixth layered member abutting against the fifth layered member, the sixth layered member having a plurality of orifices and an air chamber, wherein the orifice is in alignment with the orifice passageway to provide a stream of air parallel to a jetted liquid, and the air chamber is in air flow communication with the air conduits.

22. A method of producing a gas assisted liquid jet apparatus operable with a compressed air source and suitable for use in ink jet printers, the method comprising the steps of:

forming a transducer housing having a plurality of transducer passages, a plurality of passages for storing a liquid, an inlet and a plurality of transducer members, wherein the plurality of passages are in fluid flow communication with the inlet, and the transducer members are mounted in the transducer passages;

coupling a corresponding diaphragm member to a diaphragm member respective transducer member;

forming a plurality of chambers having a base and an outlet, wherein the chambers are in fluid flow communication with the passages, and each base is coupled to the transducer housing through a chamber respective diaphragm member, so a pressure exerted by the transducer member is transferred to the chamber causing liquid droplets to flow through the outlet;

forming an air chamber housing having an air chamber and a plurality of orifices, wherein the air chamber is in air flow communication with the compressed air source, and each orifice is in alignment with the corresponding outlet, wherein the air chamber is adapted to produce a laminar air flow through all the orifices so as to provide outwardly directed air stream which carries liquid droplets produced at the outlets; and securing the air chamber housing to the base of the chamber.

23. A method as recited in claim 22, wherein the step of forming the plurality of passages comprises the steps of forming two passages symmetrically spaced from the transducer passage, wherein two passages are in fluid flow communication with a liquid source.

24. A method of producing a gas assisted liquid jet apparatus operable with a compressed air source and suitable for use in ink jet printers, the method comprising the steps of:

forming a transducer housing having a plurality of transducer passages, a plurality of passages for storing a liquid, an inlet and a plurality of transducer members, wherein the passages are in fluid flow communication with the inlet, and each transducer member is mounted in a corresponding transducer passage;

forming a first layered member having at least one first channel in fluid flow communication with the plurality of passages, and a plurality of apertures through which a corresponding transducer member may travel;

abutting and securing the first layered member against the transducer housing;

forming a second layered member having a plurality of diaphragm members and at least one second channel, wherein the second channel is in alignment with the first channel of the first layered member, and each diaphragm member is in alignment with a corresponding transducer passage;

abutting and securing the second layered member against the first layered member;

forming a third layered member having a conduit which is in alignment and in fluid flow communication with the second channel;

abutting and securing the third layered member against the second layered member;

forming a fourth layered member having a plurality of air passages and a plurality of chambers, wherein the air passages are in air flow communication with the compressed air source, and each chamber is in alignment with a corresponding conduit;

abutting and securing the fourth layered member against the third layered member;

forming a fifth layered member having a plurality of orifice passageways and air conduits, wherein each orifice passageway is in alignment with a corresponding chamber, and the air conduits are in air flow communication with the air passages;

abutting and securing the fifth layered member against the fourth layered member;

forming a sixth layered member having a plurality of orifices and an air chamber, wherein the orifice is in alignment with the orifice passageway, and the air chamber is in air flow communication with the air conduits; and abutting and securing the sixth layered member against the fifth layered member.

25. A method as recited in claim 24, wherein the step of forming the plurality of passages comprises the steps of forming two passages symmetrically spaced from the transducer passage, wherein two passages are in fluid flow communication with a liquid source.

26. A gas assisted liquid jet apparatus operable with a compressed air source for selectively ejecting liquid droplets each having a droplet head traveling at a first velocity and a droplet ligament traveling at a second velocity upon ejection, the first velocity being greater than the second velocity, the liquid jet apparatus comprising:

a transducer housing;

a diaphragm member;

at least one transducer member disposed within the transducer housing in pressure communication with the diaphragm member for selectively exerting a pressure on the diaphragm member;

a chamber member defining a chamber for containing a volume of jettable liquid and a liquid outlet, wherein the chamber is provided in pressure communication with the transducer, through the diaphragm member, so the pressure selectively exerted by the transducer member is transferred to the chamber by the diaphragm member causing selective ejection of liquid droplets through the outlet;

an air chamber portion having an air chamber and an orifice, wherein the air chamber is in air flow communication with the compressed air source, and the orifice is in alignment with the outlet to allow an air flow through the orifice with the ejection of liquid droplets; and means for setting the velocity of the air flow through the orifice to a third velocity greater than the second velocity and less than the first velocity.

27. A gas assisted jet apparatus operable with a compressed air source for selectively ejecting droplets of a hot melt medium, the jet apparatus comprising:

a transducer housing;

a diaphragm member;

at least one transducer member disposed within the transducer housing in pressure communication with the diaphragm member for selectively exerting a pressure on the diaphragm member;

a chamber member defining a chamber for containing a volume of the hot melt medium and an outlet, wherein the chamber is provided in pressure communication with the transducer, through the diaphragm member, so the pressure selectively exerted by the transducer member is transferred to the chamber by the diaphragm member causing selective ejection of liquid droplets through the outlet;

an air chamber portion having an air chamber and an orifice, wherein the air chamber is in air flow communication with the compressed air source to receive compressed air from the compressed air source, and the orifice is in alignment with the outlet to allow an air flow through the orifice with the ejection of liquid droplets; and means for heating air received within the air chamber.

28. A method of selectively ejecting droplets of ink from an ink jet head with an assistance of compressed air where each ink droplet has a head and a ligament, the method comprising the steps of:

ejecting the ink droplet where the head is at a first velocity and the ligament is at a second velocity; and ejecting an air flow of compressed air simultaneously with the ink droplet at a third velocity, wherein the third velocity is greater than the second velocity but smaller than the first velocity, and wherein the air flow accelerates the velocity of the ligament to shorten the ligament length.

29. A method according to claim 28, further comprising the step of:

preventing debris accumulation on a surface of the ink jet head containing orifices by the ejection of air flow in front of the orifices.

* * * * *